US005193923A

United States Patent [19]

Kondo et al.

[11] Patent Number: 5,193,923

[45] Date of Patent: Mar. 16, 1993

[54] AUTOMATICALLY INTERCHANGEABLE TYPE WHEEL TYPE PRINTING APPARATUS

[75] Inventors: Hiroatsu Kondo, Zushi; Hideo Saito, Mitsukaido, both of Japan

[73] Assignee: Canon Kabushiki Kaisha, Tokyo, Japan

[21] Appl. No.: 536,087

[22] Filed: Jun. 11, 1990

Related U.S. Application Data

[63] Continuation of Ser. No. 244,174, Sep. 14, 1988, abandoned.

[30] Foreign Application Priority Data

Sep. 24, 1987 [JP] Japan ..... 62-240124

[51] Int. Cl.[5] ..... B41J 1/30

[52] U.S. Cl. ..... 400/171; 400/144.2; 400/175

[58] Field of Search ..... 400/144.2, 144.3, 149, 400/150, 151, 151.1, 171, 174, 175

[56] References Cited

U.S. PATENT DOCUMENTS

| | | | |
|---|---|---|---|
| 4,026,403 | 5/1977 | Inose et al. | 400/171 |
| 4,289,412 | 9/1981 | Dollenmayer | 400/171 |
| 4,307,968 | 12/1981 | Habich et al. | 400/171 |
| 4,480,932 | 11/1984 | Willcox | 400/171 |
| 4,722,621 | 2/1988 | Johnson | 400/144.2 |

FOREIGN PATENT DOCUMENTS

| | | | |
|---|---|---|---|
| 212573 | 3/1987 | European Pat. Off. | 400/171 |
| 218039 | 1/1985 | German Democratic Rep. | 400/171 |
| 131067 | 8/1983 | Japan | 400/171 |

*Primary Examiner*—David A. Wiecking

*Attorney, Agent, or Firm*—Fitzpatrick, Cella, Harper & Scinto

[57] ABSTRACT

By the driving of drive means for the vertically moving member of a type wheel in one way and resiliently holding means for the type wheel, the type wheel is moved upwardly to a position suitable for printing with the vertically moving member of the type wheel by pivotal movement, whereafter the resilient holding of the type wheel by the resiliently holding means is released by the driving of the drive means in the other way, whereby only the vertically moving member of the type wheel is contained in a type wheel containing housing, and by the driving of the drive means in one way after the termination of printing, the type wheel is resiliently held on the vertically moving member of the type wheel by the resiliently holding means, whereafter by the driving of the drive means in the other way, the type wheel, with the vertically moving member of the type wheel, is contained in the type wheel containing housing.

11 Claims, 4 Drawing Sheets

AUTOMATICALLY INTERCHANGEABLE TYPE WHEEL TYPE PRINTING APPARATUS

This application is a continuation of application Ser. No. 244,174 filed Sep. 14, 1988, now abandoned.

BACKGROUND OF THE INVENTION

1. Filed of the Invention

This invention relates to an automatically interchangeable type wheel type printing apparatus. Vertically moving members contain a plurality of type wheels in a type wheel containing housing which movably mounted on a carrier, a desired type wheel is moved to a position suitable for printing.

2. Related Background Art

There have existed printers which has a plurality of type members each provided with a plurality of printing types and each continuing printing while automatically interchanging the type members. Such devices are disclosed, for example, in U.S. Pat. No. 4,357,115, U.S. Pat. No. 4,281,938, U.S. Pat. No. 4,026,403 and Japanese Patent Application Laid-Open No. 58-39464.

However, these printers are not always satisfactory from the viewpoint of high-speed printing. So, to solve this problem, in Japanese Patent Application No. 60-177754 (U.S. application Ser. No. 896,056 filed on Aug. 13, 1986) there has been proposed a printer designed such that a plurality of disc-like type wheels are carried on a carriage and a desired type wheel is automatically mounted by a wheel interchanging mechanism provided on the carriage.

Further, in Japanese Patent Application No. 61-168289 (U.S. application Ser. No. 73,216 filed on Jul. 14, 1987) there has been proposed a printer in which an interchanging mechanism for mounting or dismounting type wheels carried on a carriage at a printing position or therefrom and a mechanism for moving an ink ribbon up and down are operated by a common drive source to thereby reduce the number of parts and lighten the carriage.

In this type of automatically interchangeable type wheel printing apparatus, when the vertically moving member of a type wheel is to be moved vertically, the opposite ends of the vertically moving member of the type wheel have been driven by a belt a lever or the like through engagement members, but the driving device for the vertical movement of the vertically moving member of such a type wheel is complex and increases the production cost and in addition, increases the weight and volume of the carrier, and this has proved a hindrance to improved printing speed and compactness of the apparatus, particularly, small height of the entire apparatus.

SUMMARY OF THE INVENTION

It is an object of the present invention to solve the above-noted problem and to more effectively improve on an automatically interchangeable type wheel type printer.

It is another object of the present invention to simplify the apparatus construction and make the carrier lighter in weight and improve the printing efficiency.

It is still another object of the present invention to make the central position of type wheels contained in a type wheel containing housing through the vertically moving members of the type wheels eccentric from the vertical line of the center at a position of the type wheels suitable for printing and near to said center, thereby reducing the height of the entire apparatus.

Other objects of the present invention will become apparent from the following detailed description of an embodiment thereof.

DESCRIPTION OF THE PREFERRED EMBODIMENT

Figure 1:
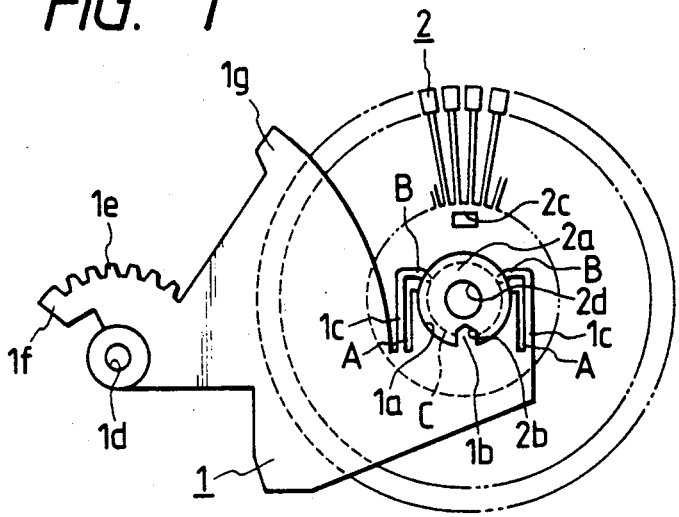
FIG. 1 shows the construction of a type wheel according to an embodiment of the present invention and the vertically moving member of the type wheel.

An embodiment of the present invention will hereinafter be described with reference to the drawings. Referring to FIG. 1, the reference numeral 1 designates the vertically moving member of a type wheel. The vertically moving member of the type wheel has in one end portion thereof a concave depression 1*a* engaged with the boss portion 2*a* of the type wheel 2 from below it, a projection 1*b* upwardly projectedly provided substantially in the central portion of the concave depression 1*a*, and a pair of holding portions 1*c* as resilient holding means provided with resilient engaging members B provided upright with slight gaps A left on the opposite sides of the concave depression la, and has in the other end portion thereof a projected portion 1*f* for preventing meshing engagement between a gear portion 1*e* having a shaft hole 1*d* as a core and a driving gear 3 as driving means which will be described later in detail at an inaccurate position. Also, substantially in the central portion of the vertically moving member 1 of the type wheel, there is upwardly provided an engaging surface 1*g* adapted to engage a guide groove 5 (shown in FIGS. 4 to 6) formed substantially arcuately in a carrier 4 during the rotation of the vertically moving member 1 of the type wheel about said shaft hole 1*d* to thereby prevent lateral vibration of the vertically moving member 1 of the type wheel.

Figure 2:
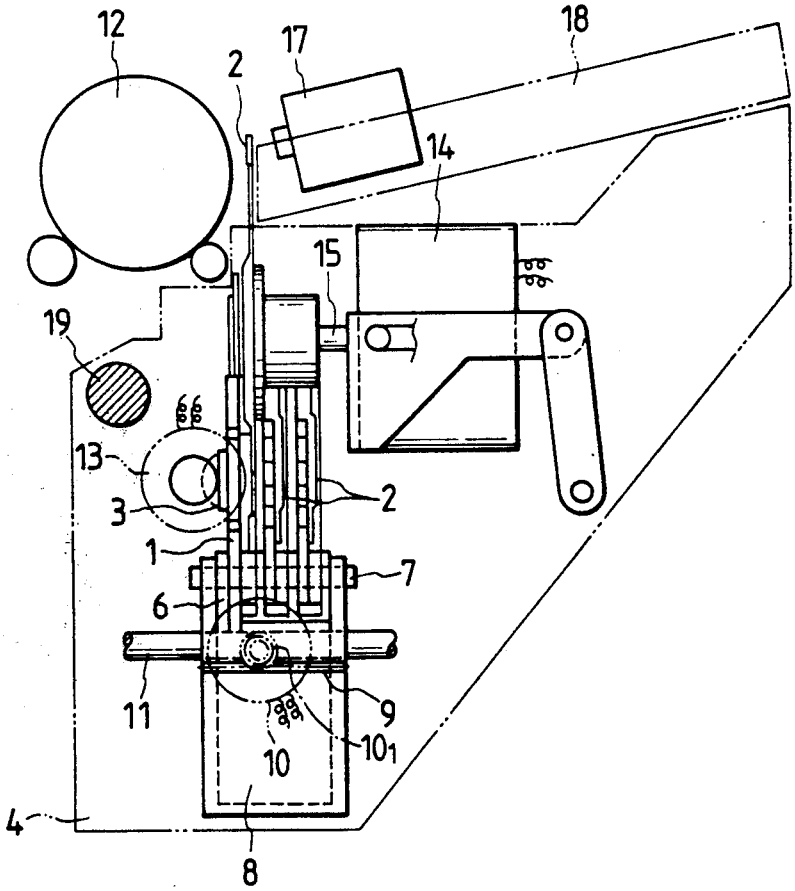
FIG. 2 shows the construction of an entire apparatus provided with a plurality of type wheels and vertically moving members as shown in FIG. 1.
Figure 3:
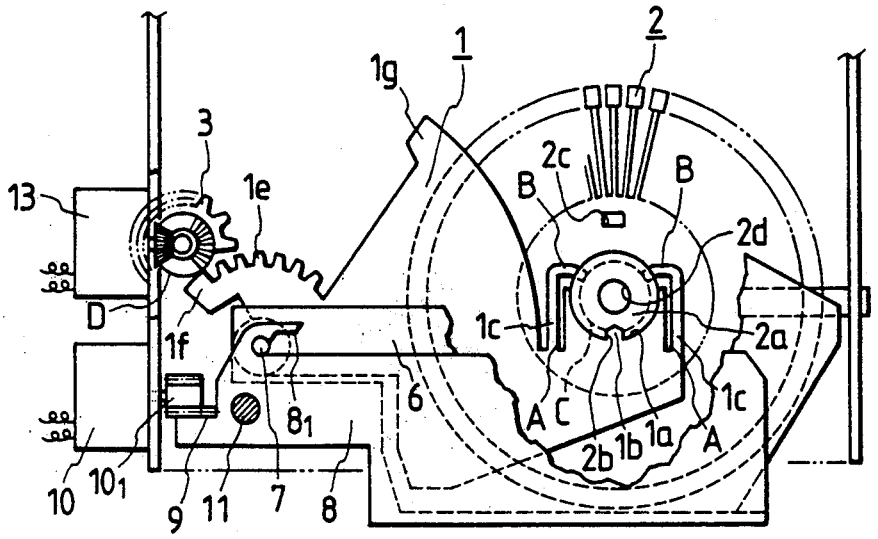
FIG. 3 illustrates the operation by which the type wheel shown in FIG. 2 is contained in a containing housing.
Figure 4:
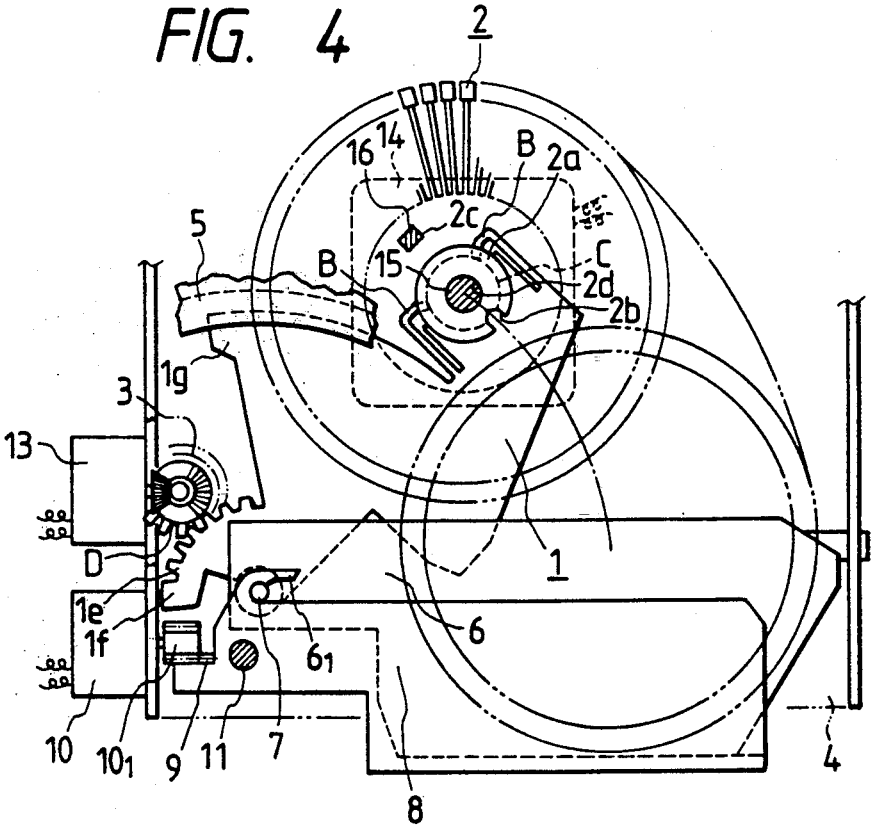
FIG. 4 illustrates the operation when the type wheel shown in FIG. 3 has been moved to the printing position.
Figure 7:
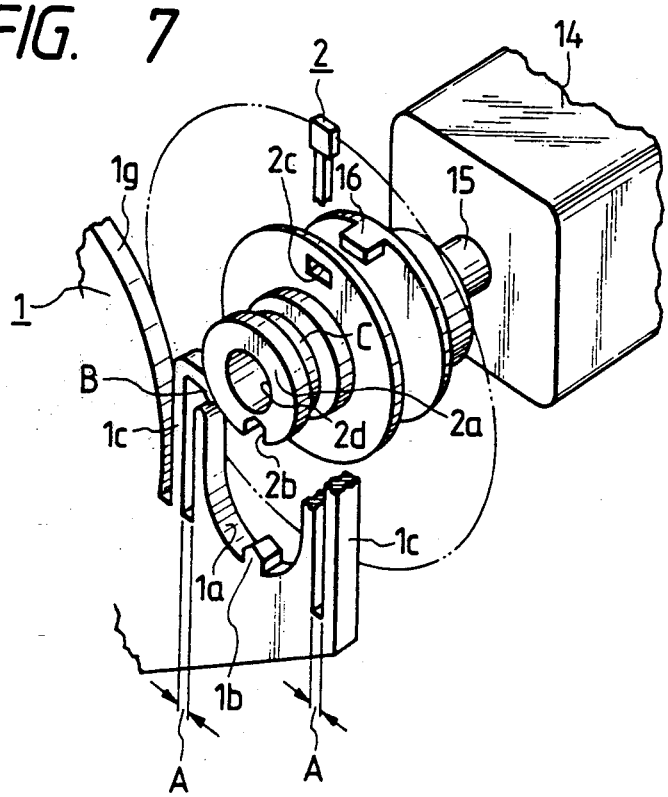
FIG. 7 is a detailed view of the engaging portions of the type wheel and the vertically moving member shown in FIG. 2.

The projection 1*b* of the vertically moving member 1 of the type wheel is engaged with a cut-away 2*b* formed in the lower part of the boss portion 2*a* of the type wheel 2 to thereby bring the boss portion 2*a* into engagement with the concave depression 1*a* of the vertically moving member 1 of the type wheel, and the engaging members B of the pair of holding portions 1*c* are brought into resilient engagement with the annular groove C of the boss portion 2*a*, and as shown in FIG. 2, a plurality of such vertically moving members 1 by which a plurality of such type wheels 2 are resiliently held are contained at predetermined intervals for pivotal movement in a type wheel containing housing 6 with the shaft holes 1*d* thereof mounted on a shaft 7 provided in the type wheel containing housing 6. In FIG. 2, the reference numeral 8 designates a bearer for the type wheel containing housing 6. The bearer 8 is provided on a carrier 4 and is movable with the type wheel containing housing 6 in a direction orthogonal to the axial direction of a platen 12 mounted for rotation on a machine bed (not shown) (the left to right direction as viewed in FIG. 2), along a support shaft 11 provided in the carrier 4, through a rack portion 9 provided on the bearer 8 and the gear $10_1$, of a drive motor 10 provided on the carrier 4. The platen is formed lengthwisely to support recording paper. As shown in FIG. 3, the type wheel containing housing 6 is mounted in such a manner as to be capable of being temporarily stopped by the engagement between an opening engaging portion $8_1$, formed in one end portion of the bearer 8 and the shaft 7, and is removably insertable relative to the bearer 8 in a horizontal direction (the rightward direction as viewed in FIG. 3). The driving gear 3 is adapted to be rotated by the drive of a motor 13 as drive means provided on the carrier 4. A part of the toothed portion of the driving gear 3 which meshes with the gear portion 1*e* of the vertically moving member 1 of the type wheel is untoothed at D so that the gear portion 1*e* of the vertically moving member 1 of the type wheel may not contact with the driving gear 3 in the home position of the driving gear 3 when the type wheel containing housing 6 is moved with the bearer 8 by the drive of the drive motor 10 and when the type wheel containing housing 6 is set on the bearer 8. By being rotated from the home position as shown in FIG. 4, the driving gear 3 meshes with the gear 1*e* of the vertically moving member 1 of the type wheel at an accurate position so that the vertically moving member 1 of the type wheel is vertically moved with the type wheel 2 by the oscillation thereof. In FIG. 7, the reference numeral 14 denotes a wheel motor for selectively rotating the type wheels 2, the reference numeral 15 designates the rotating shaft thereof, and the reference numeral 16 denotes a positioning projection provided integrally with the rotating shaft 15 and adapted to be engaged with a connecting hole 2*c* formed in the type wheel 2 by the wheel motor 14 moving forward, to thereby position and connect the rotating shaft 15 and the type wheel 2 together.

Figure 6:
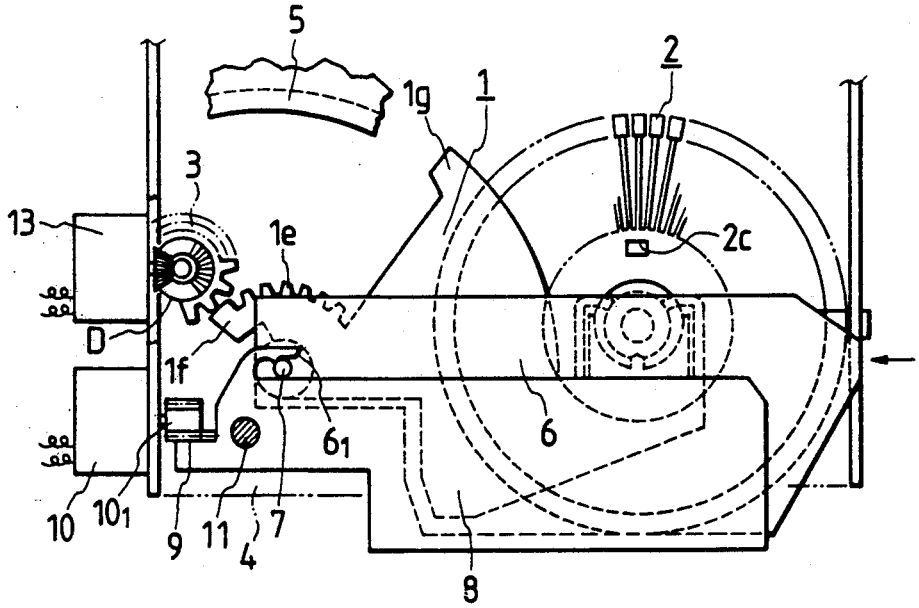
FIG. 6 illustrates a state in which when the containing housing shown in FIG. 2 is not positioned at the home position of a driving gear, it cannot be set on a bearer.

FIG. 6 shows a state in which if an attempt is made to set the type wheel containing housing 6 on the bearer 8 when the driving gear 3 is not in the home position, the projection 1*f* of the vertically moving member 1 of the type wheel strikes against the toothed portion of the driving gear 3 to thereby prevent the driving gear 3 from meshing with the gear portion 1*e* of the vertically moving member 1 of the type wheel at an inaccurate position and therefore the type wheel containing housing 6 cannot be set on the bearer 8.

Figure 8:
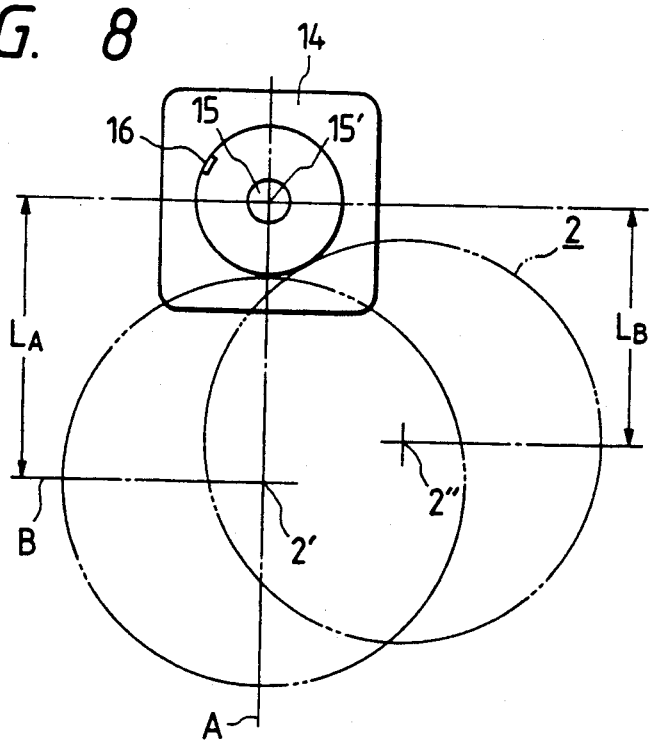
FIG. 8 shows the positional relation of the type wheel shown in FIG. 2 with a wheel motor.

FIG. 8 shows the positional relations between the position suitable for printing of the type wheel 2 and the position in which the type wheel is containied in the type wheel containing housing 6 in the prior-art apparatus and the apparatus of the present invention. The distance LA from the center 15' of the rotating shaft 15 to the center 2' of the type wheel 2 in the conventional case, where the type wheel is contained in a type wheel containing housing 6 wherein the center 2' of the type wheel 2 is positioned on the vertical line of the center 15' of the type wheel 2 in the position suitable for printing (i.e., on the vertical line of the center 15' of the rotating shaft of the wheel motor 14), is greater then the distance $L_B$ from the center 15' of the rotating shaft 15 the center 2'' of the type wheel 2 in a case where the center 2'' of the type wheel 2 of the present invention is eccentric from the vertical line A and is positioned above the horizontal line B of the center 2' of the conventionally positioned type wheel 2. Therefore, the distance between the the type wheel hole and the center of the rotating shaft becomes smaller.

Figure 5:
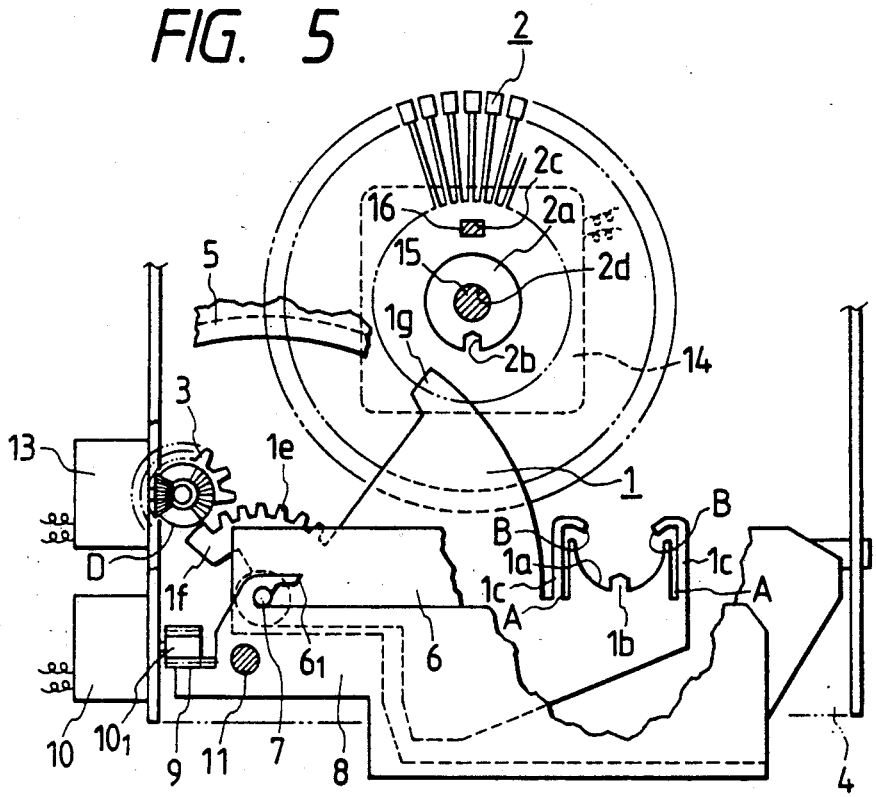
FIG. 5 illustrates the operation when only the vertically moving member shown in FIG. 4 has been contained in the containing housing.

In the above-described construction, desired one of the type wheels 2, resiliently held on the carrier 4 by resilient engagement so as to be moved through the bearer 8 is positioned at a portion suitable for printing in the upward movement process by the pivotal movement of the vertically moving member 1 of the type wheel due to the meshing engagement with the gear portion 1*e* of the vertically moving member 1 of the type wheel 2, by rotation of the driving gear 3, as shown in FIG. 4, and in this state, the rotating shaft 15 of the wheel motor 14 is brought into engagement with the engagement hole 2*d* of the type wheel 2 by the forward movement of the wheel motor 14 and the positioning projection 16 provided on the rotating shaft 15 is brought into engagement with the connecting hole 2*c* to thereby position the type wheel, whereafter in the downward movement process by the pivotal movement of the vertically moving member 1 of the type wheel due to the rotation of the driving gear 3 in the opposite direction, the engaging member B of the holding portion 1*c* of the vertically moving member 1 of the type wheel is spaced apart from the annular groove C of the boss portion 2*a* of the type wheel 2 against the resiliency of the engaging member B, whereby only the vertically moving member of the type wheel is contained in the type wheel containing housing 6. In this state, the type wheel 2 is selectively rotated by the wheel motor 14 and printing is effected. (FIG. 5 shows this state.) When printing is terminated, the engaging member B of the holding portion 1*c* of the vertically moving member 1 of the type wheel resiliently engages the annular groove C of the boss portion 2*a* of the type wheel 2 in the upward movement process by the pivotal movement of the vertically moving member 1 of the type wheel toward the type wheel 2 by the rotation of the driving gear 3, and the rotating shaft 15 of the wheel motor 14 cames out of engagement with the engagement hole 2*d* of the type wheel 2 and the positioning projection 16 comes out of engagement with the connecting hole 2*c*, by backward movement of the wheel motor 14, whereupon the vertically moving member 1 of the type wheel is contained in the type wheel containing housing 6 while resiliently holding the type wheel 2, by the rotation of the driving gear 3 to the home position in the opposite direction and by the downward movement process in the pivotal movement of the vertically moving member 1 of the type wheel. The driving gear 3 in its home position has its meshing engagement with the gear portion 1*e* of the vertically moving member 1 of the type wheel released, and the type wheel containing housing 6, with the bearer 8, becomes movable to a position for selecting the next desired type wheel 2.

The reference numerals 17 and 18 designate a printing hammer and a ribbon cassette, respectively, provided on the carrier 4, and the reference numeral 19 denotes the support shaft of the carrier 4. The carrier 4 is reciprocally movable in the axial direction of the platen 12 along the platen.

As described above, by a simple construction in which the vertically moving member of the type wheel provided with resiliently holding means for the type wheel and a gear portion meshing with a driving gear as drive means for pivotally moving the vertically moving member is pivotally moved by said drive means, the type wheel can be reliably positioned at the position suitable for printing and the containing position of the wheel containing housing and therefore, as compared with the prior-art apparatus, simplification of the entire apparatus can be realized and in addition, not only a light weight of the carrier, a reduced production cost and improved printing efficiency can be achieved, but also the central position of the type wheels contained in the type wheel containing housing through the vertically moving members of the type wheels is eccentric from the vertical line at the center of the type wheels in the position suitable for printing and is near the rotating shaft of the wheel motor, whereby the height of the entire apparatus can be made smaller than that of the prior-art apparatus.

What is claimed is:

1. An automatically interchangeable type wheel printer including:

a platen; and a carrier reciprocally movable along said platen; said carrier having:

a type wheel container for housing a plurality of type wheels, said type wheel container being movably provided in said carrier for a type wheel selecting operation;

type wheel moving members for raising the type wheels to a printing position, with one of said type wheel moving members each corresponding to one type wheel for pivotally moving a corresponding type wheel between the printing position for printing and a home position in said container, said type wheel moving members each having at one end thereof an engaging portion engaged with its corresponding type wheel and having at the other end thereof a center of rotation and a drive force transmitting portion;

first drive means for rotating a selected type wheel moving member about its center of rotation, said first drive means having its drive force transmitted to said selected type wheel moving member through said drive force transmitting portion; and second drive means for rotatively driving the type wheel in the printing position, said second drive means having a restraining portion for restraining the type wheels moved to the printing position by said corresponding type wheel moving member.

2. A printer according to claim 1, wherein said first drive means further comprises a drive shaft having a driving gear, and said drive force transmitting portion of each of said type wheel moving members is a gear portion meshing with said driving gear.

3. A printer according to claim 2, wherein said driving gear has an untoothed portion, and said driving gear does not mesh with said gear portion due to said untoothed portion when said container is being moved.

4. A printer according to claim 1, wherein the central position of the type wheels housed in said container is eccentric from a vertical line drawn through the center of the type wheels while at the printing position.

5. A printer according to claim 1, wherein said engaging portion engages the type wheel at three points about its rotational axis, with said engaging portion including a projection engageable with a recess in a central hub of the type wheel and two elastic arms engaging the hub on opposite sides of the rotational axis, and wherein said elastic arms deform to release the hub when the typing wheel is moved to a printing position.

6. A printer for recording on a recording medium, comprising:

a platen;

a hammer; and a carrier reciprocally movable along said platen, said carrier having a plurality of character wheels, wheel containing means for containing said character wheels, pick-up means, engageable with said character wheels contained in said wheel containing means, for picking up one of said character wheel from said wheel containing means and placing it at a printing position, with said pick-up means including individual pick-up members corresponding to each of said character wheels to be picked up and having a rotational center about which said pick-up means is rotatable, wherein said pick-up means is retracted to a home position after placing said character wheel at the printing position, and mounting means for mounting said character wheel picked up by said pick-up means at the printing position.

7. A printer according to claim 6, wherein said pick-up means contains a concave depression engageable with a boss portion of said character wheel at an engaging end of said pick-up means opposite to the rotational center.

8. A printer according to claim 6, wherein said pick-up members each include an engaging portion for engaging a type wheel at three points about its rotational axis, with said engaging portion including a projection engageable with a recess in a central hub of the type wheel and two elastic arms engaging the hub on opposite sides of the rotational axis, and wherein said elastic arms deform to release the hub when the typing wheel is moved to a printing position.

9. A printer according to claim 7, wherein said pick-up means contains a geared portion along a part of a circumference of the rotational center.

10. A printer according to claim 7, further comprising resilient engaging means disposed at said engaging end of said pickup means for resiliently engaging the base portion of said character wheel.

11. A printer according to claim 7, further comprising a projection projecting from the concave depression and engageable with a notch in the base portion of said character wheel.

* * * * *

UNITED STATES PATENT AND TRADEMARK OFFICE

CERTIFICATE OF CORRECTION

PATENT NO. : 5,193,923

DATED : March 16, 1993

INVENTOR(S) : Kondo, et al.

It is certified that error appears in the above-indentified patent and that said Letters Patent is hereby corrected as shown below:

COLUMN 1:

Line 9, "Filed" should read --Field--.
Line 14, "carrier, a" should read --carrier. A--.

COLUMN 4:

Line 7, "shaft 15" should read --shaft 15 and--.
Line 50, "cames" should read --comes--.

COLUMN 6:

Line 26, "wheel" should read --wheels--.

Signed and Sealed this

Fifth Day of April, 1994

Bruce Lehman

*Attest:*

BRUCE LEHMAN

*Attesting Officer*

*Commissioner of Patents and Trademarks*